US007839071B2

(12) United States Patent
Niibori et al.

(10) Patent No.: US 7,839,071 B2
(45) Date of Patent: Nov. 23, 2010

(54) VACUUM CONTAINER AND METHOD FOR MANUFACTURING THE SAME, AND IMAGE DISPLAY APPARATUS AND METHOD FOR MANUFACTURING THE SAME

(75) Inventors: Kenji Niibori, Kanagawa (JP); Nobuyuki Takahashi, Kanagawa (JP); Kazuyuki Ueda, Tokyo (JP); Ryoji Tanaka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 362 days.

(21) Appl. No.: 11/751,274

(22) Filed: May 21, 2007

(65) Prior Publication Data

US 2007/0210689 A1 Sep. 13, 2007

Related U.S. Application Data

(62) Division of application No. 10/622,432, filed on Jul. 21, 2003, now abandoned.

(30) Foreign Application Priority Data

Jul. 29, 2002 (JP) ..... 2002-219956

(51) Int. Cl.
*H01J 1/62* (2006.01)

(52) U.S. Cl. ..... 313/495; 313/238

(58) Field of Classification Search ..... 313/495–497, 313/292, 238, 309–311
See application file for complete search history.

(56) References Cited

U.S. PATENT DOCUMENTS

| | | | | |
|---|---|---|---|---|
| 5,734,224 | A | 3/1998 | Tagawa et al. | 313/493 |
| 5,811,927 | A * | 9/1998 | Anderson et al. | 313/495 |
| 5,859,497 | A | 1/1999 | Anderson et al. | 313/495 |
| 5,905,335 | A * | 5/1999 | Fushimi et al. | 313/495 |
| 5,936,343 | A | 8/1999 | Fushimi et al. | 313/495 |
| 5,952,775 | A | 9/1999 | Sato et al. | 313/422 |
| 6,803,715 | B1 * | 10/2004 | Mitsutake et al. | 313/495 |
| 7,078,854 | B2 | 7/2006 | Niibori et al. | 313/495 |

FOREIGN PATENT DOCUMENTS

| | | |
|---|---|---|
| JP | 9-179508 | 7/1997 |
| JP | 2000-251796 | 9/2000 |

* cited by examiner

*Primary Examiner*—Bumsuk Won
(74) *Attorney, Agent, or Firm*—Fitzpatrick, Cella, Harper & Scinto

(57) ABSTRACT

The present invention relates to a vacuum container having a first substrate and a second substrate arranged so as to face each other as components including, within the low-pressure container, a spacer disposed at the first substrate or the second substrate so as to maintain an interval between the first substrate and the second substrate. The spacer is fixed within the vacuum container via a supporting member provided at the spacer without contacting the substrate where the spacer is disposed. The invention also relates to a method for manufacturing vacuum container, an image display apparatus using the vacuum container, and a method for manufacturing the image display apparatus.

7 Claims, 10 Drawing Sheets

VACUUM CONTAINER AND METHOD FOR MANUFACTURING THE SAME, AND IMAGE DISPLAY APPARATUS AND METHOD FOR MANUFACTURING THE SAME

This is a divisional of application Ser. No. 10/622,432, filed on Jul. 21, 2003.

BACKGROUND OF THE INVENTION

1. Field of the Invention

The present invention relates to a vacuum container incorporating spacers and a method for manufacturing the same, and an image display apparatus using the vacuum container and a method for manufacturing the same.

2. Description of the Related Art

Flat display apparatuses are attracting attention as a replacement for CRT (cathode-ray tube) display apparatuses because they are thin and light. Particularly, display apparatuses in which electron emission elements and phosphors emitting light by being irradiated with electron beams are expected to have characteristics superior to other conventional display apparatuses. For example, in comparison with recently diffused liquid-crystal display apparatuses, the above-described display apparatuses are superior in that back light is unnecessary because they emit light themselves, and the angle of visibility is large.

FIG. 17 is a perspective view illustrating a display panel constituting a flat image display apparatus. In order to show the internal structure, a portion of the display panel is cut. In FIG. 17, there are shown a rear plate 3115, a side wall 3116, and a faceplate 3117 that constitute an envelope (airtight container) for maintaining the inside of the display panel to a vacuum.

A substrate 3111 is fixed on the rear plate 3115, and cold-cathode elements 3112 are provided on the substrate 3111 in the form of an N×M matrix (N and M are positive integers equal to or larger than 2, and appropriately set in accordance with a required number of display pixels). As shown in FIG. 17, the N×M cold-cathode elements 3112 are wired by row-direction wires 3113 and column-direction wires 3114. A portion constituted by the substrate 3111, the cold-cathode elements 3112, the row-direction wires 3113 and the column-direction wires 3114 is termed a multi-electron-beam source. An insulating layer (not shown) is formed between two wires at at least portions where the row-direction wires 3113 and the column-direction wires 3114 cross, in order to secure electric insulation.

A fluorescent screen 3118 comprising phosphors is formed on the lower surface of the faceplate 3117, in which phosphors (not shown) of three primary colors, i.e., red (R), green (G) and blue (B), are separately coated. A black material is formed between adjacent phosphors constituting the fluorescent screen 3118, and a metal back 3118 made of Al or the like is formed on a surface of the fluorescent screen 3118 facing the rear plate 3115.

There are also shown airtight terminals for electric connection Dx1-Dxm, Dy1-Dyn and Hv provided for electrically connecting the display panel to an electric circuit (not shown). The terminals Dx1-Dxm, Dy1-Dyn and Hv are electrically connected to the row-direction wires 3113 and the column-direction wires 3114 of the multi-electron beam source, and the metal back 3119, respectively.

The inside of the airtight container is maintained to a vacuum of about $3\times10^{-3}$ Pa ($10^{-6}$ Torr). As the display area of the image display apparatus increases, it becomes necessary to provide means for preventing deformation or destruction of the rear plate 3115 and the faceplate 3117 due to a pressure difference between the inside and the outside of the airtight container. An approach of increasing the thicknesses of the rear plate 3115 and the faceplate 3115 will increase the weight of the image display apparatus and produce deformation and parallax of an image when the image is seen from an oblique direction. In order to solve this problem, in the configuration shown in FIG. 17, spacers 3120, each comprising a relatively thin glass plate, for supporting the atmospheric pressure are provided. The interval between substrate 311 where the multi-electron-beam source is formed and the faceplate 3117 where the fluorescent screen 3118 is formed is usually maintained to a sub-millimeter value or a few millimeters, and the inside of the airtight container is maintained to a high vacuum, as described above.

In the image display apparatus using the above-described display panel, when a voltage is applied to each of the respective cold-cathode elements 3112 via corresponding ones of the outside-container terminals Dx1-Dxm and Dy1-Dyn, electrons are emitted from the corresponding one of the cold-cathode elements 3112. At the same time, by applying a high voltage of several hundred to several thousand volts to the metal back 3119 via the outside-container terminal Hv, the emitted electrons are accelerated to impinge upon the inner surface of the faceplate 3117. A corresponding one of the phosphors of respective colors constituting the fluorescent screen 3118 is thereby excited to emit light, whereby an image is displayed.

The spacers 3120 are efficiently arranged with a number necessary for the structure of the display panel. When disposing the spacers 3120 within an image region with a length shorter than the image region, the spacers 3120 are fixed within the image region of at least one of the rear plate 3115 and the faceplate 3117 using connecting members.

As disclosed in Japanese Patent Application Laid-Open (Kokai) Nos. 9-179508 (1997) and 2000-251796 (2000), when using spacers 3120 longer than the image region, an atmospheric-pressure-resistant structure can be obtained only by fixing both ends of the spacers 3120. At that time, a method may be adopted in which supporting members are fixed in advance at both ends of each of the spacers 3120, and the supporting members are fixed to the rear plate 3115 or the faceplate 3117 using connecting members.

The above-described display panel of the image display apparatus has the following problems.

Since a plurality of spacers are disposed in accordance with the display area of the display panel, and the thicknesses of the rear plate and the faceplate, the number of the spacers increases as the display area increases. As a result, the number of processes for disposing the spacers in the display-panel assembling process increases, thereby causing an increase in the production cost. Particularly, when disposing spacers shorter than the image region within the image region, a serious problem will arise.

When using spacers longer than the image region, it is possible to minimize the number of the spacers. However, when supporting members are fixed in advance at both ends of each of the spacers longer than the image region, and the supporting members are fixed in a state of directly contacting the substrate, accuracy in the fixed positions of the spacers and the supporting members is sometimes influenced by accuracy in the verticality of the spacers with respect to the substrate, and variations in the height of disposition when the spacers are fixed on the substrate. If a spacer is inclined by this influence, the electron trajectory from an electron emission element near the spacer may be interfered, or the electron trajectory may be distorted by disturbance of the electric field near the element, thereby influencing image display. In addition, when accommodating the spacers between the rear plate and the faceplate, a large stress may be applied to the spacers, resulting in destruction of the spacers and incapability of providing a vacuum within the display panel.

In the case of a display panel having a plurality of spacers, if the height of disposition when fixing the spacers on the substrate varies, the spacers do not contact the rear plate and the faceplate as designed, resulting in destruction of the spacers and incapability of providing a vacuum within the display panel.

SUMMARY OF THE INVENTION

It is an object of the present invention to provide a low-pressure container capable of maintaining designed reliability by preventing inclination of a spacer disposed within the low-pressure container or variations in the height of disposition of the spacer due to an atmospheric-pressure-resistant structure of the low-pressure container, during or after manufacturing the low-pressure container, an image display apparatus using the low-pressure container, and a method for manufacturing the low-pressure container or the image display apparatus.

According to one aspect of the present invention, a vacuum container having a first substrate and a second substrate arranged so as to face each other as components includes, within the low-pressure container, a spacer disposed at the first substrate or the second substrate so as to maintain an interval between the first substrate and the second substrate. The spacer is fixed within the vacuum container via a supporting member provided at the spacer without contacting the substrate where the spacers are provided.

According to another aspect of the present invention, an image display apparatus includes, within the above-described vacuum container, a plurality of electron emission elements arranged on the first substrate, and an image display member arranged on the second substrate.

According to still another aspect of the present invention, a vacuum container having a first substrate and a second substrate arranged so as to face each other as components includes, within the low-pressure container, a spacer disposed at the first substrate or the second substrate so as to maintain an interval between the first substrate and the second substrate. The spacer is fixed within the low-pressure container via a supporting member provided at the spacer with a gap with the substrate where the spacer is disposed.

According to yet another aspect of the present invention, an image display apparatus includes, within the above-described vacuum container, electron emission elements arranged on the first substrate, and an image display member arranged on the second substrate.

According to yet a further aspect of the present invention, a method for manufacturing a vacuum container having a first substrate and a second substrate arranged so as to face each other as components, and a spacer disposed at the first substrate or the second substrate within the vacuum container includes the steps of fixing a supporting member on a surface other than a surface of disposition of the spacer with respect to the concerned substrate at both ends of the spacer with a distance from the surface of installation, and disposing the spacer where the supporting member is fixed at the first substrate or the second substrate and fixing the supporting member on the substrate where the spacer is disposed.

According to still another aspect of the present invention, a method for manufacturing an image display apparatus having a vacuum container having a first substrate and a second substrate arranged so as to face each other as components, and a spacer, electron emission elements on the first substrate, and an image display member on the second substrate that are disposed within the vacuum container includes the step of manufacturing the vacuum container according to the above-described method.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Figure 1:
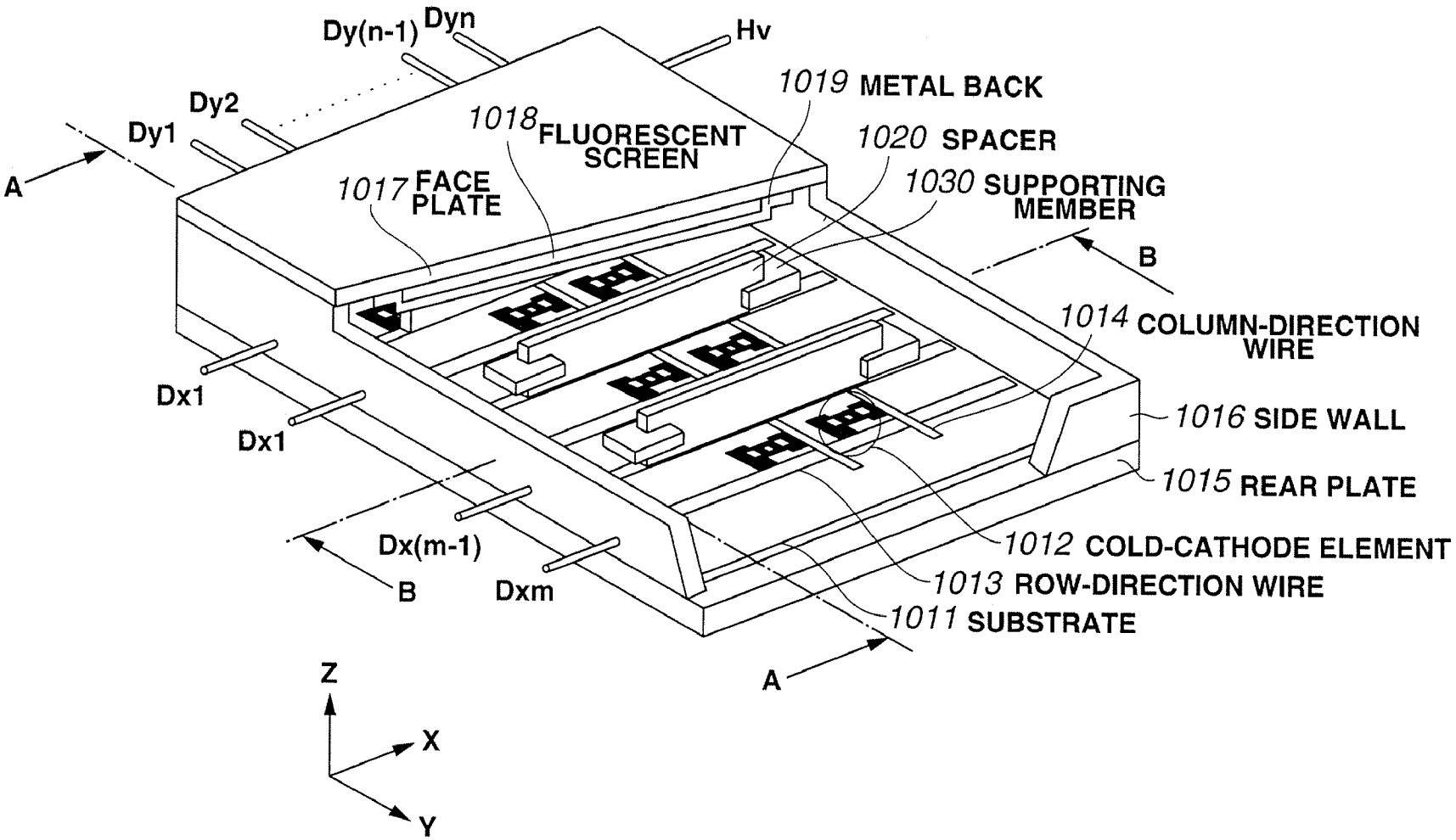
FIG. 1 is a partially broken perspective view illustrating a display panel of an image forming apparatus according to an embodiment of the present invention.

The present invention relates to a vacuum container having a first substrate and a second substrate arranged so as to face each other as components, including, within the vacuum container, a spacer disposed at the first substrate or the second substrate so as to maintain an interval between the first substrate and the second substrate. The spacer is fixed within the vacuum container via a supporting member provided at the spacer without contacting the substrate where the spacer is provided.

The present invention relates to a vacuum container having a first substrate and a second substrate arranged so as to face each other as components, including, within the low-pressure container, a spacer provided at the first substrate or the second substrate so as to maintain an interval between the first substrate and the second substrate. The spacer is fixed within the vacuum container via a supporting member provided at the spacer with a gap with the substrate where the spacer is provided.

In the above-described vacuum container, it is preferable that the spacer is fixed to the substrate where the spacer is disposed, via the supporting member provided at the spacer without contacting the substrate where the spacer is disposed.

In the above-described vacuum container, it is preferable that the spacer is fixed to the substrate where the spacer is disposed, via the supporting member provided at the spacer with a gap with the substrate where the spacer is disposed.

In the above-described vacuum container, it is preferable that the supporting member is connected to the substrate by means of a first connecting member.

In the above-described vacuum container, it is preferable that the supporting member is connected to the spacer by means of a second connecting member.

The present invention relates to an image display apparatus including, within the above-described vacuum container, a plurality of electron emission elements arranged on the first substrate and an image display member arranged on the second substrate.

In the above-described image display apparatus, it is preferable that the spacer is disposed on wires for driving the plurality of electron emission elements arranged on the first substrate.

In the above-described image display apparatus, it is preferable that the supporting member is disposed outside an electron-beam emission region.

The present invention relates to a method for manufacturing a vacuum container having a first substrate and a second substrate arranged so as to face each other as components, and a spacer disposed at the first substrate or the second substrate within the vacuum container, including the steps of fixing a supporting member on a surface other than a surface of disposition of the spacer with respect to the concerned substrate at both ends of the spacer with a distance from the surface of disposition, and disposing the spacer where the supporting member is fixed at the first substrate or the second substrate and fixing the supporting member on the substrate where the spacer is disposed.

The present invention relates to a method for manufacturing an image display apparatus having a vacuum container having a first substrate and a second substrate arranged so as to face each other as components, and a spacer, electron emission elements on the first substrate, and an image display member on the second substrate that are disposed within the vacuum container, including the step of manufacturing the low-pressure container according to the above-described method.

In the above-described image-display-apparatus manufacturing method, it is preferable that the spacer is disposed on wires for driving the plurality of electron emission elements arranged on the first substrate.

The present invention relates to an image display apparatus including a first substrate having a plurality of electron emission elements provided within a vacuum container, a second substrate to be irradiated by electrons emitted from the electron emission elements, disposed so as to face the first substrate within the vacuum container, at least one spacer disposed on one of the first substrate and the second substrate as an atmospheric-pressure-resistant structure and sandwiched between the first substrate and the second substrate, having a longitudinal direction in a direction perpendicular to a facing direction of the first substrate and the second substrate, a side wall present at an inner side of an outer circumferential portion of at least one of the first substrate and the second substrate as a closed structure of the vacuum apparatus, and a supporting member for supporting the spacer at portions outside of an electron emission region, serving as a region between a region where the electron emission elements are provided on the first substrate and a region irradiated with electrons on the second substrate. A gap is provided between the first substrate or the second substrate where the spacer is disposed and the supporting member.

In the above-described image display apparatus, a space is provided between a plane including a surface of the spacer facing a spacer disposing surface of the substrate where the spacer is disposed and a surface of the supporting member facing the spacer disposing surface of the substrate where the spacer is disposed, and the supporting member is provided in a space between the plane including the surface of the spacer facing the spacer disposing surface of the substrate where the spacer is disposed and a plane including a surface of the spacer opposite to a surface facing the substrate.

In the above-described image display apparatus, a portion of the substrate where the spacer is disposed facing the supporting member is thinner than a portion of the substrate contacted by the spacer within the electron emitting region in the direction of thickness of the substrate.

In the above-described image display apparatus, the first substrate or the second substrate where the spacer is disposed and the supporting member is connected by means of a first connecting member, and the spacer and the supporting member are connected by means of a second connecting member.

In the above-described image display apparatus, the supporting member is fixed on the substrate where the spacer is disposed together with the spacer in a state of being fixed to the spacer.

In the above-described image display apparatus, the height of the supporting member is smaller than the spacer with respect to the direction of facing the first substrate and the second substrate, and the supporting member supports one end portion or both end portions of the spacer in the longitudinal direction.

In the above-described image display apparatus, the substrate for the spacer is preferably insulating. In this case, a high-resistance thin film is formed on the surface of the substrate for the spacer, and the surface resistance of the high-resistance thin film is desirably $10^5$-$10^{12}\Omega/\square$.

In the above-described image display apparatus, the spacer is preferably disposed on a wire for driving the electron source for emitting electrons.

In the above-described image display apparatus, an electron source for emitting electrons is preferably a cold-cathode element. For example, the cold-cathode element is a surface-conduction-type electron emitting element.

In the above-described vacuum-container manufacturing method and image-display-apparatus manufacturing method, a step of positioning the spacer to a predetermined position on the first substrate or the second substrate is provided. The positioning step preferably includes a step of clamping substantially both end portions of the spacer in a spacer assembling apparatus, and positioning the spacer to a predetermined position on one of the first substrate and the second substrate.

In the above-described vacuum-container manufacturing method and image-display-apparatus manufacturing method, it is preferable to provide a step of releasing clamping of substantially both end portions of the spacer of the spacer assembling apparatus, after fixing the supporting member and the substrate by a first connecting member.

In the above-described low-pressure container or image display apparatus, when disposing the spacer at one of the first substrate and the second substrate where the spacer is disposed, the supporting member fixed in advance to the spacer do not directly contact the substrate. Accordingly, verticality of the spacer with respect to the substrate, and the height of disposition when the spacer is fixed on the substrate do not vary by being influenced by accuracy in assembly of the spacer and the supporting member. It is thereby possible to realize very high accuracy in the verticality of the spacer with respect to the substrate, and prevent variations in the height of disposition when the spacer is fixed on the substrate.

As a result, the spacer after assembly contacts the first substrate and the second substrate as designed, and a vacuum within the envelope can be maintained with high reliability.

Since the position of the spacer does not deviate, the trajectory of electrons emitted from the first substrate side is not influenced.

Since accuracy in assembly of the spacer and the supporting member can be loosely set, it is possible to fix the spacer and the supporting member with an easy method, and loosen accuracy of the supporting member. It is thereby possible to increase the throughput of assembly of the spacer and the supporting member, and suppress the cost of each supporting member to a low value.

In this specification, the term "image region" or "image display region" indicates a space sandwiched between a region where electrons are emitted and a region irradiated by the emitted electrons.

A preferred embodiment of the present invention will now be described with reference to the drawings.

FIG. 1 is a perspective view illustrating a display panel of an image display apparatus according to the embodiment. In order to show the internal structure, a portion of the display panel is cut. In FIG. 1, there are shown a rear plate 1015, serving as a first substrate, a side wall 1016, serving as a frame, and a faceplate 1017, serving as a second substrate, that constitute an airtight container (envelope) for maintaining the inside of the display panel to a vacuum.

The inside of the airtight container is maintained to a vacuum of about $10^{-6}$ Torr. In order to prevent destruction of the airtight container due to the atmospheric pressure, an unexpected shock or the like, spacers 1020 are provided as an atmospheric-pressure-resistant structure.

A substrate 1011 is fixed to the rear plate 1015, and cold-cathode elements 1012 are provided on the substrate 1011 in the form of an N×M matrix (N and M are positive integers equal to or larger than 2, and appropriately set in accordance with a required number of display pixels). A fluorescent screen 1018 is formed on the lower surface of the faceplate 1017.

Figure 14A:
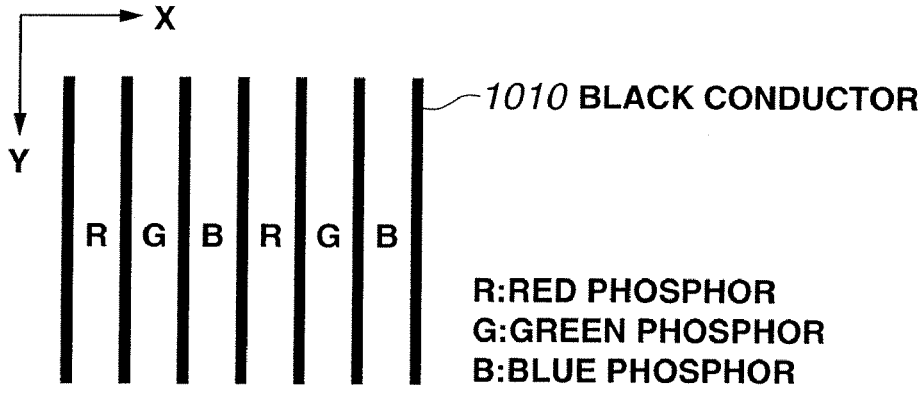
FIGS. 14A-14C are plan views, each illustrating arrangement of phosphors on the faceplate of the display panel shown in FIG. 1.

Phosphors of respective colors are coated, for example, in the form of a stripe, and a black conductor (not shown) is provided between adjacent phosphor stripes (see FIG. 14A).

A metal back that is known in the field of CRT is provided on a surface of the fluorescent screen 1018 facing the rear plate 1015.

The spacer 1020 is obtained by forming a high-resistance film on the surface of a thin insulating member, and electrodes (not shown) are formed on the inside of the faceplate 1017 and a contact surface of the spacer 1020 facing the surface of the substrate 1011 (row-direction wires 1013).

The spacers 1020 having the shape of a thin plate are arranged along the row direction (x direction) so as to extend from a range sandwiched between the cold-cathode elements 1012 and the fluorescent screen 1018 to the outside. Supporting members 1030 are fixed in advance to both ends of the spacer 1020. The supporting members 1030 are fixed on the rear plate 1015. At that time, supporting members 1030 and the rear plate 1015 do not directly contact, such that a gap is present or second connecting members (not shown) are provided between the supporting members 1030 and the rear plate 1015.

(Configurations of the Spacers, the Supporting Members and the Rear Plate)

First, a description will be provided of configurations of the spacers 1020, the supporting members 1030 and the rear plate 1015 with reference to FIGS. 2-6.

Figure 2:
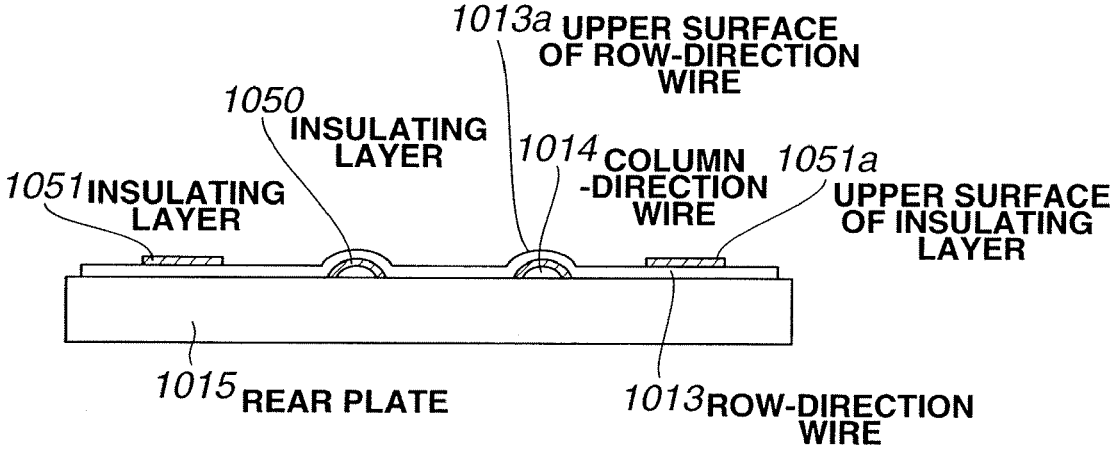
FIG. 2 is a cross-sectional view illustrating a rear plate shown in FIG. 1, taken along line B-B.

FIG. 2 is a cross-sectional view illustrating the rear plate 1015, taken along line B-B shown in FIG. 1. Row-direction wires 1013 and column-direction wires 1014 for driving electron sources for emitting electrons, and insulating layers 1050 for electrically insulating the row-direction wires 1013 from the column-direction wires 1014 are formed within an electron-emission region of the rear plate 1015. The row-direction wires 1013 and insulating layers 1051 are formed outside of the electron emission region in the longitudinal direction (x direction) of the row-direction wires 1013 of the rear plate 1015. At that time, the height of the upper surface 1013*a* of the row-direction wire 1013 contacted by the spacer 1020 within the electron emission region of the rear plate 1015, and the height of the upper surface 1051*a* of the insulating layer 1051 where the supporting member 1030 outside of the electron emission region of the rear plate 1015 is fixed, in the direction of the thickness of the plate, are set to substantially the same value.

Figure 3:
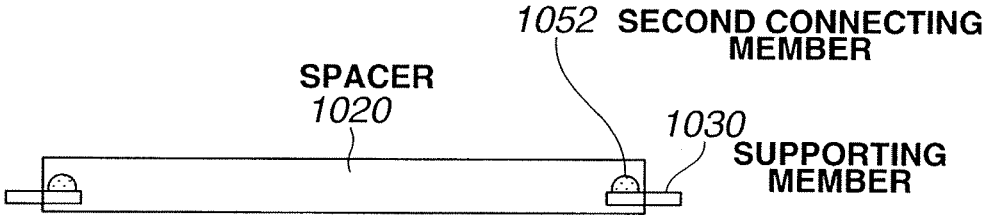
FIG. 3 is a side view illustrating a spacer and supporting members shown in FIG. 1, as seen from the y direction.
Figure 4:
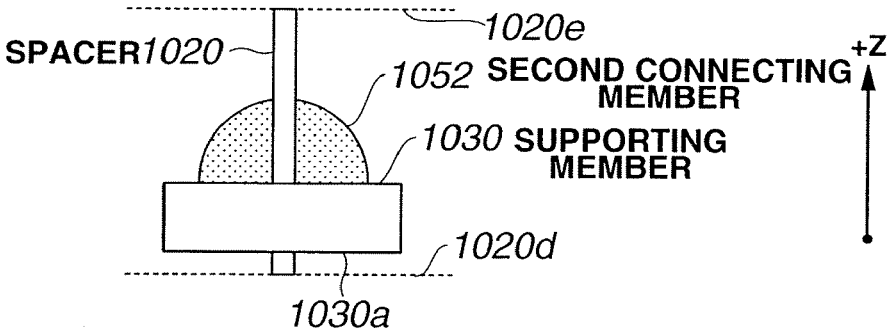
FIG. 4 is an enlarged view illustrating the spacer and the supporting member shown in FIG. 1, as seen from the x direction.
Figure 5:
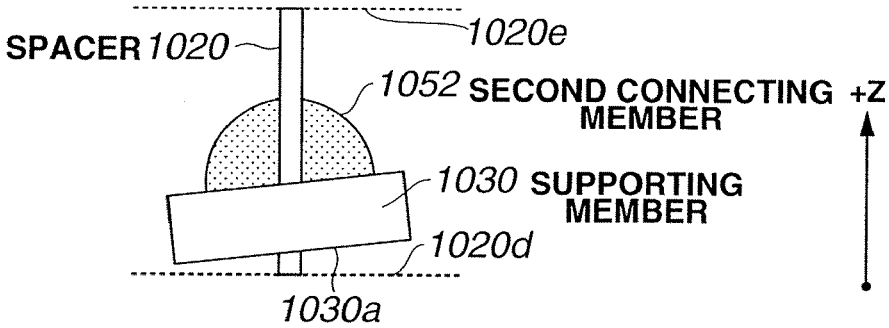
FIG. 5 is an enlarged view illustrating another shape of the spacer and the supporting member shown in FIG. 1, as seen from the x direction.

Next, a description will be provided of the spacer 1020 and the supporting members 1030 with reference to FIGS. 3-5. FIG. 3 is a side view of the spacer 1020 and the supporting members 1030, as seen from the y direction. FIGS. 4 and 5 are enlarged side views of the spacer 1020 and the supporting members 1030, as seen from the x direction.

As shown in FIG. 3, the supporting members 1030 are fixed at both ends of the spacer 1020 using second connecting members 1052. At that time, a space is provided between a plane 1020*d* including a surface of the spacer 1020 facing the spacer disposing surface of the rear plate 1015 and a surface 1030*a* of the supporting member 1030 facing the spacer disposing surface of the rear plate 1015, and the supporting members 1030 are provided in a space between a plane 1020*d* of the spacer 1020 including a surface facing the spacer disposing surface of the rear plate 1015 and a plane 1020*e* of the spacer 1020 including a surface opposite to a surface facing the rear plate 1015. Accordingly, as shown in FIG. 5, when the surface 1030*a* of the supporting member 1030 facing the rear plate 1015 is inclined with respect to a surface of the spacer 1020 facing the rear plate 1015, by moving the fixed position of the supporting member 1030 with respect to the spacer 1020 to a +z direction, a space is provided between the plane 1020*d* of the spacer 1020 including the surface facing the spacer disposing surface of the rear plate 1015 and the surface 1030*a* of the supporting member 1030 facing the spacer disposing surface of the rear plate 1015.

Figure 6:
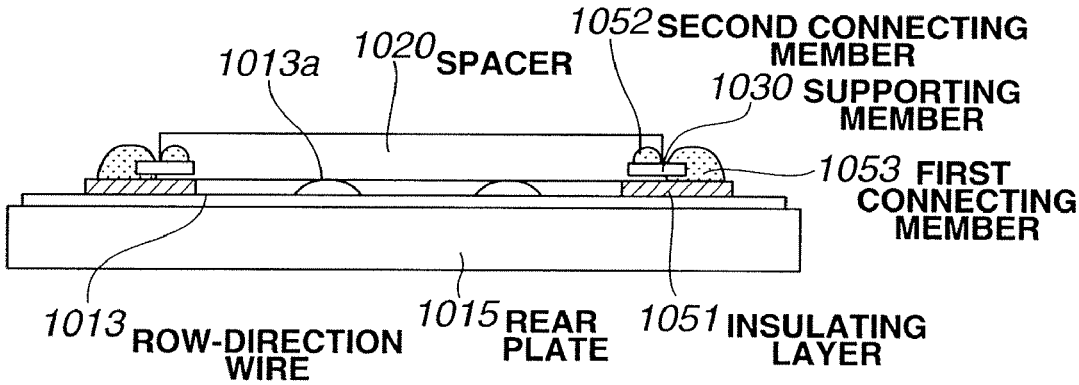
FIG. 6 is a diagram illustrating the positional relationship among the rear plate, the spacer and the supporting members shown in FIG. 1.

Next, a description will be provided of connection of the spacer 1020 to the rear plate 1015 and the spacer 1020 with reference to FIG. 6. The spacer 1020 is positioned by a spacer assembling apparatus (not shown) so as to be substantially vertical on the center of the row-direction wire 1013 within the electron emission region of the rear plate 1015, and the supporting members 1030 are bonded and fixed on the rear plate 1015 by means of first connecting members 1053. At that time, since the surfaces of the supporting members 1030 facing the rear plate 1015 are retracted with respect to a plane extended from the surface of the spacer 1020 facing the rear plate 1015 (see FIGS. 3-5), the supporting members 1030 do not contact the rear plate 1015. Accordingly, by providing the first connecting members 1053 between the rear plate 1015 and the supporting members 1030, or so as to be along the outer circumference of the supporting members 1030 and the surface of the rear plate 1015, the supporting members 1030 can be fixed on the rear plate 1015.

Next, a description will be provided of another configurations of the spacer 1020, the supporting members 1030 and the rear plate 1015 with reference to FIGS. 7-10.

Figure 7:
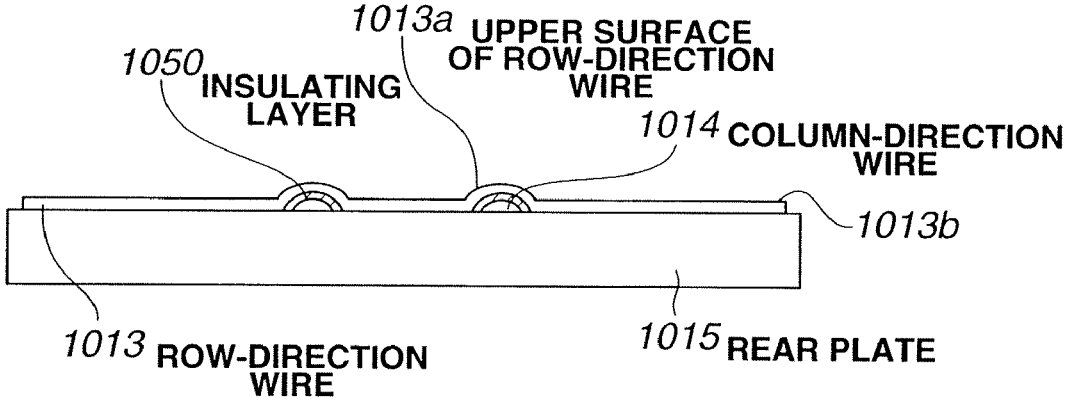
FIG. 7 is a cross-sectional view illustrating another shape of the rear plate shown in FIG. 1, taken along line B-B.

The row-direction wires 1013 and the column-direction wires 1014 for driving electron sources for emitting electrons, and the insulating layers 1050 for electrically insulating the row-direction wires 1013 from the column-direction wires 1014 are formed within the electron-emission region of the rear plate 1015 shown in FIG. 7. On the other hand, only the row-direction wires 1013 are formed outside of the electron emission region in the longitudinal direction (x direction) of the row-direction wires 1013 of the rear plate 1015. Accordingly, a portion 1013*b* of the row-direction wire 1013 facing the supporting member 1030 outside of the electron emission region of the rear plate 1015 is thinner in the direction of the thickness than the upper surface 1013*a* of the row-direction wire 1013 contacted by the spacer 1020 within the electron emission region of the rear plate 1015.

Figure 8:
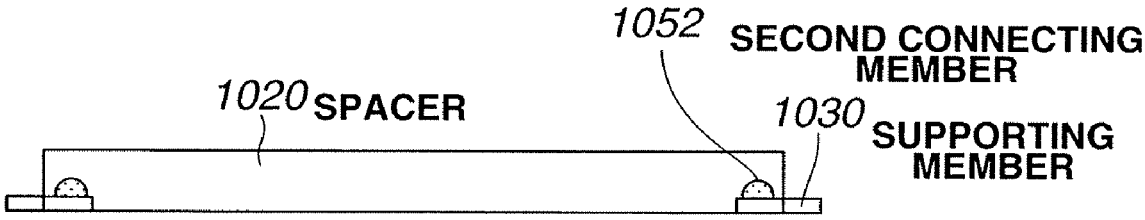
FIG. 8 is a side view illustrating another shapes of the spacer and the supporting members shown in FIG. 1, as seen from the y direction.
Figure 9:
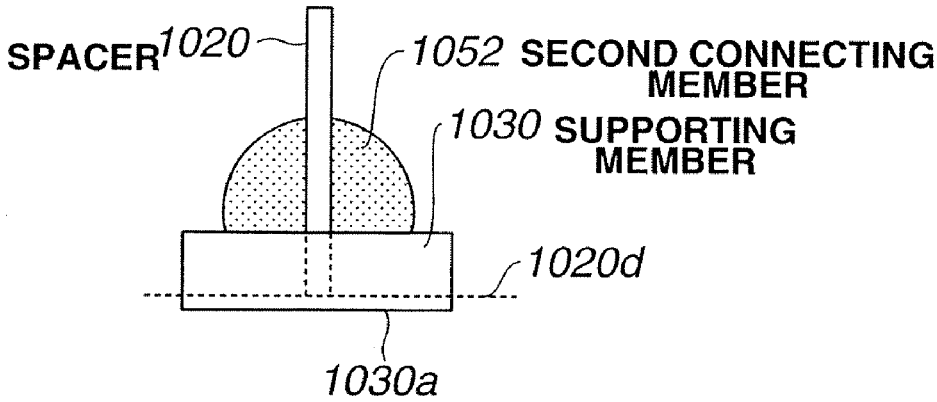
FIG. 9 is an enlarged view illustrating still another shapes of the spacer and the supporting member shown in FIG. 1, as seen from the y direction.

Next, a description will be provided of another configurations of the spacer 1020 and the supporting members 1030 with reference to FIGS. 8 and 9.

FIG. 8 is a side view illustrating the spacer 1020 and the supporting members 1030 shown in FIG. 1, as seen from the y direction. FIG. 9 is a side view illustrating the spacer 1020 and the supporting member 1030, as seen from x direction.

As shown in FIGS. 8 and 9, the supporting members 1030 are fixed in advance to both ends of the spacer 1020 using the second connecting members 1052. As for the fixed position of the spacer 1020 and supporting members 1030, it is not particularly necessary to provide a space between the plane 1020*d* including the surface of the spacer 1020 facing the spacer disposing surface of the substrate where the spacer 1020 is disposed and the surface 1030*a* of the supporting member 1030 facing the spacer disposing surface of the substrate where the spacer 1020 is disposed. No problem will arise even if the surface 1030*a* of the supporting member 1030 facing the spacer disposing surface of the substrate where the spacer 1020 is disposed is closer to the rear plate 1015 than the surface of the spacer 1020 facing the spacer disposing surface of the substrate where the spacer 1020 is disposed. However, the value of the dimension for allowing the surface 1030*a* of the supporting member 1030 facing the spacer disposing surface of the substrate where the spacer 1020 is disposed to be closer to the rear plate 1015 than the plane 1020*d* of the spacer 1020 including the surface facing the spacer disposing surface of the substrate where the spacer 1020 is disposed must be smaller than the difference between the dimensions in the direction of thickness between the surface 1013*a* of the row-direction wire 1013 contacted by the spacer 1020 within the electron emission region of the rear plate 1015, and the portion 1013*b* of the row-direction wire 1013 where the supporting member 1030 outside of the electron emission region of the rear plate 1015 is fixed.

Figure 10:
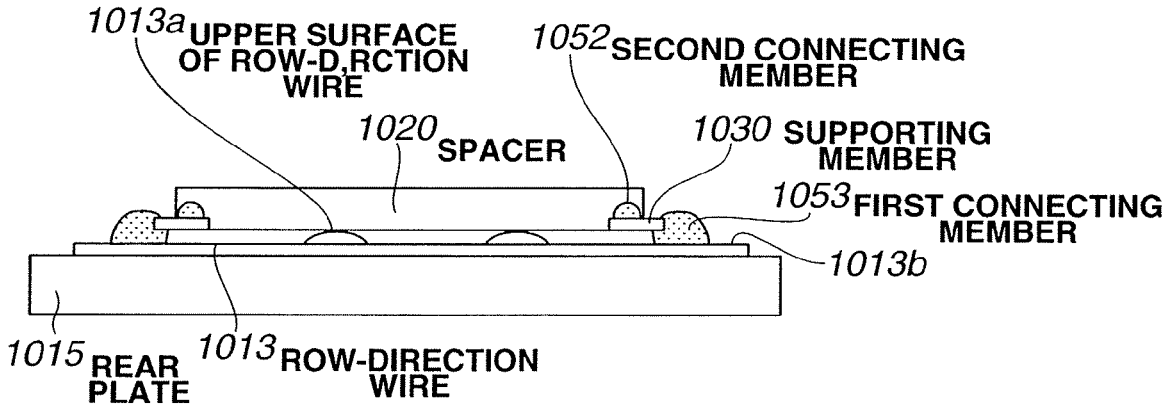
FIG. 10 is a diagram illustrating another shape of the rear plate, the spacer and the supporting members shown in FIG. 1.

Next, a description will be provided of fixing of the spacer 1020 to the rear plate 1015 with reference to FIG. 10. The spacer 1020 is positioned by the spacer assembling apparatus so as to be substantially vertical on the center of the row-direction wire 1013 within the electron emission region of the rear plate 1015, and the supporting members 1030 are bonded and fixed on the rear plate 1015 by the first connecting members 1053. At that time, since the portion 1013*b* of the row-direction wire 1013 facing the supporting member 1030 outside of the electron emission region of the rear plate 1015 is thinner in the direction of the thickness than the upper surface 1013*a* of the row-direction wire 1013 contacted by the spacer 1020 within the electron emission region of the rear plate 1015, the supporting members 1030 do not contact the rear plate 1015. Accordingly, by providing the first connecting members 1053 between the rear plate 1015 and the supporting members 1030, or so as to be along the outer circumference of the supporting members 1030 and the surface of the rear plate 1015, the supporting members 1030 are fixed on the rear plate 1015.

(Spacer Assembling Process)

Next, a description will be provided of a procedure for assembling the vacuum container of the invention with reference to FIGS. 11A-12B. For convenience of explanation, the assembling procedure is divided into portions shown in FIGS. 11A and 11B, and FIGS. 12A and 12B.

Figure 11A:
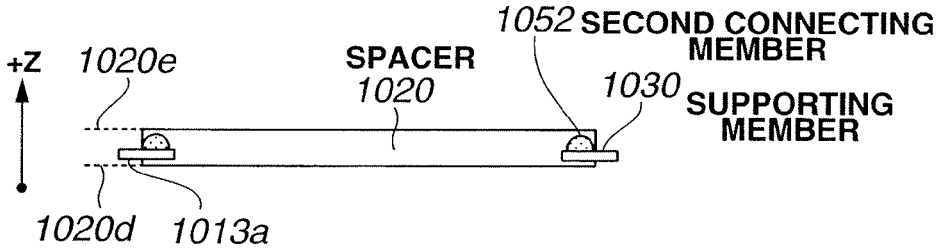
FIGS. 11A and 11B are diagrams illustrating processes for assembling the display panel shown in FIG. 1.
Figure 11B:
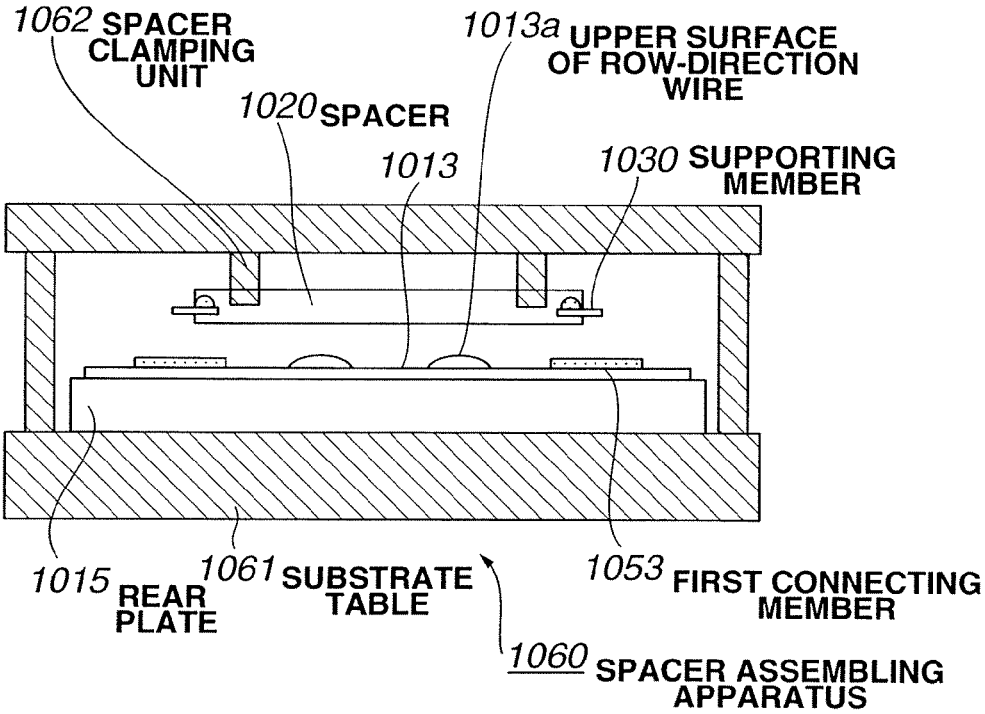

First, as shown in FIG. 11A, the supporting members 1030 are fixed to both ends of the spacer 1020 using the second connecting members 1052. A space is provided between the plane 1020*d* including the surface of the spacer 1020 facing the spacer disposing surface of the rear plate 1015 and the surfaces 1030*a* of the supporting members 1030 facing the spacer disposing surface of the rear plate 1015, and the supporting members 1030 are provided in a space between the plane 1020*d* of the spacer 1020 including the surface facing the spacer disposing surface of the rear plate 1015 and the plane 1020*e* of the spacer 1020 including the surface opposite to the surface facing the rear plate 1015.

Next, a description will be provided of a process for positioning the spacer 1020 and the supporting members 1030 that have been assembled in advance to predetermined positions on the rear plate 1015, using a spacer assembling apparatus 1060. The spacer assembling apparatus 1060 includes s substrate table 1061 for supporting the rear plate 1015, and spacer clamping units 1062 for clamping the spacer 1020. The perpendicularity between the plane of the substrate table 1061 and the spacer clamping units 1062 is adjusted within 90±0.1 degrees. By clamping portions of the spacer 1020 near portions fixed by the supporting members 1030 by the spacer clamping units 1062, the spacer 1020 is positioned to a predetermined position on the rear plate 1015 supported on the substrate table 1061 and is caused to contact the rear plate 1015.

Figure 12A:
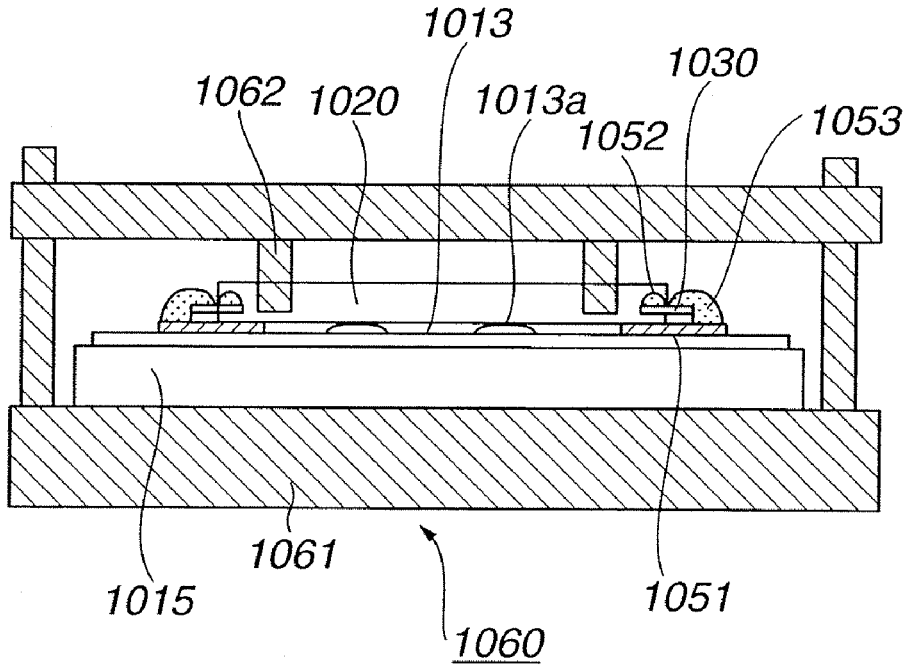
FIGS. 12A and 12B are diagrams illustrating processes for assembling the display panel shown in FIG. 1, succeeding the processes shown in FIGS. 11A and 11B.

Then, as shown in FIG. 12A, the supporting members 1030 are bonded and fixed to the rear plate 1015 by means of the first contacting members 1053. At that time, since the surfaces of the supporting members 1030 facing the rear plate 1015 are in the +z direction with respect to a plane extended from the surface of the spacer 1020 facing the rear plate 1015 (see FIG. 11A), the supporting members 1030 do not contact the rear plate 1015. Accordingly, by providing the first connecting members 1053 between the rear plate 1015 and the supporting members 1030, or so as to be along the outer circumference of the supporting members 1030 and the surface of the rear plate 1015, the supporting members 1030 are fixed on the rear plate 1015. Upon completion of bonding and fixing of the supporting members 1030 to the rear plate 1015, the spacer clamping units 1062 of the spacer assembling apparatus 1060 release clamping of substantially both end portions of the spacer 1020.

Figure 12B:
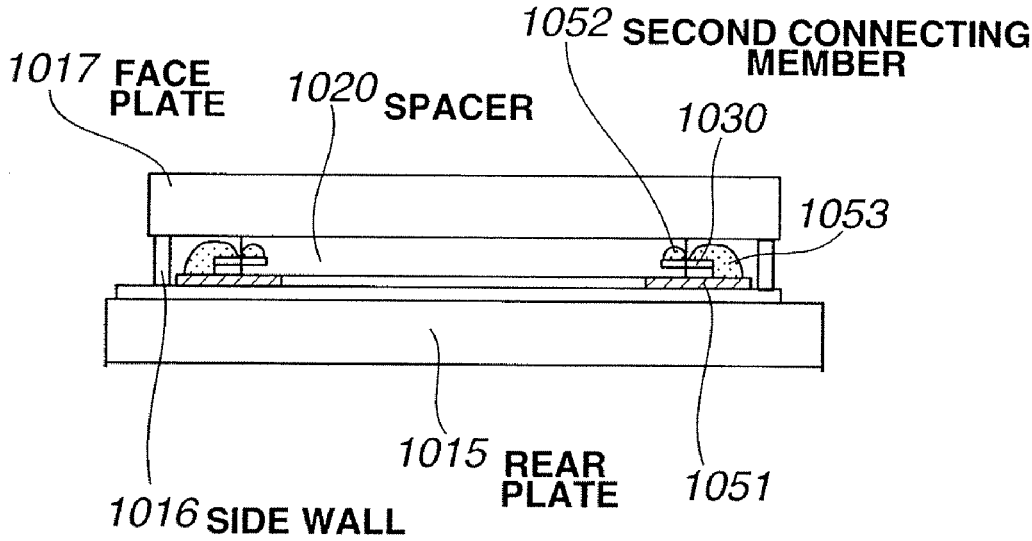

Next, a description will be provided of fixing of the faceplate 1017 and the rear plate 1015 with reference to FIG. 12B. The fixing is performed by disposing the spacers 1020 and the side wall 1016 between the faceplate 1017 and the rear plate 1015, as shown in FIG. 1. The spacers 1020 have substantially the same height as or a slightly smaller height than the side wall 1016. Accordingly, the gap between the faceplate 1017 and the rear plate 1015 is provided by the height of the spacer 1020. The faceplate 1017 is caused to approach the rear plate 1015 so as to be substantially parallel to the plane of the rear plate 1015. Then, the faceplate 1017 contacts the spacers 1020 and the side wall 1016. In this state, a contact portion between the side wall 1016 and the faceplate 1017 is sealed, to make the closed space surrounded by the faceplate 1017, the rear plate 1015 and the side wall 1016 in a vacuum state.

As described above, the supporting members 1030 are fixed in advance to both ends of the spacer 1020 longer than the image region using the second connecting members 1052, and are further fixed on the rear plate 1015 via the first connecting members 1053. The supporting members 1030 and the rear plate 1015 do not directly contact, and are fixed by means of the second connecting members 1053.

As a result, the verticality of the spacers 1020 with respect to the plane of the rear plate 1015 is determined by accuracy of the spacer assembling apparatus 1060, and is not influenced by accuracy of assembly of the spacers 1020 and the supporting members 1030. Accordingly, it is possible to set the verticality of the spacers 1020 with respect to the plane of the rear plate 1015 to a very high level, and prevent interference on the electron trajectory from an electron emission element near the spacer 1020, or distortion of the electron trajectory by disturbance of the electric field near the electron emission element, thereby influencing image display. In addition, it is also possible to prevent destruction of the spacers 1020 due to a large stress generated when accommodating the spacers 1020 between the rear plate 1015 and the faceplate 1017, and incapability of providing a vacuum within the display panel.

Since the spacers 1020 are fixed to the rear plate 1015 by directly contacting it, the height when fixing the spacers 1020 on the substrate does not vary. It is thereby possible to contact the spacers 1020 to the rear plate 1015 and the faceplate 1017 as designed, and prevent destruction of the spacers 1020 or incapability of providing a vacuum within the display panel.

Since the spacers 1020 are fixed at portions outside of the image display region, it is only necessary to locally coat an adhesive, such as frit glass or the like, even if heating is performed. When using an adhesive that does not require heating, a conventionally performed heat process can be omitted.

Outline of the Image Display Apparatus

Next, the configuration and the manufacturing method of the display panel of the image display apparatus according to the invention will be described illustrating a specific example.

Referring to FIG. 1 illustrating the display panel of the embodiment, the airtight container (envelope) for maintaining the inside of the display panel to a vacuum is formed by the rear plate 1015, the side wall 1016, and the faceplate 1017. When assembling the airtight container, sealing must be performed in order to maintain a sufficient strength and an airtight property at connecting portions of the respective components. Sealing is achieved, for example, by coating frit glass on connecting portions and firing the coated frit glass in the air or a nitrogen atmosphere at 400-500 degrees for least ten minutes. A method for evacuating the inside of the airtight container to a vacuum will be described later. The inside of the airtight container is maintained to a vacuum of about $10^{-6}$ Torr. In order to prevent destruction of the airtight container due to the atmospheric pressure, an unexpected shock or the like, the spacers 1020 are provided as an atmospheric-pressure-resistant structure.

Next, a description will be provided of an electron-emission-element substrate that can be used for the image display apparatus of the invention.

An electron-source substrate used in the image display apparatus of the invention is formed by arranging a plurality of cold-cathode elements on the substrate.

Methods for arranging cold-cathode elements include a ladder-type arrangement in which both ends of respective cold-cathode elements are connected by wires (hereinafter termed a "ladder-type-arrangement electron-source substrate"), and a simple-matrix arrangement in which x-direction wires and y-direction wires of respective pairs of element electrodes of cold-cathode elements are connected (hereinafter termed a "matrix-type-arrangement electron-source substrate"). An image display apparatus having a ladder-type-arrangement electron-source substrate requires a control electrode (grid electrode) for controlling the trajectory of electrons from each electron emission element.

The substrate 1011 is fixed to the rear plate 1015, and the cold-cathode elements 1012 are provided on the substrate 1011 in the form of an N×M matrix (N and M are positive integers equal to or larger than 2, and appropriately set in accordance with a required number of display pixels. For example, in a display apparatus for displaying high-quality television, it is desirable to set numbers equal to or larger than N=3,000 and M=1,000). The N×M cold-cathode elements are subjected to simple matrix wiring by M row-direction wires 1013 and N column-direction wires 1014. A portion constituted by the substrate 1011, the cold-cathode elements 1012, the row-direction wires 1013 and the column-direction wires 1014 is termed a multi-electron-beam source.

In the multi-electron-beam source used in the image display apparatus of the invention, there are no limitations in the material, the shape and the manufacturing method of the cold-cathode elements, provided that the cold-cathode elements are subjected to simple matrix wiring or ladder-type arrangement.

Accordingly, for example, surface-conduction-type emission elements, or FE(field emission)-type or MIM(metal-insulator-metal)-type cold-cathode elements may be used.

Next, a description will be provided of the structure of a multi-electron-beam source in which surface-conduction-type emission elements (to be described later) are arranged on a substrate as cold-cathode elements, and are subjected to simple matrix wiring.

Figure 13:
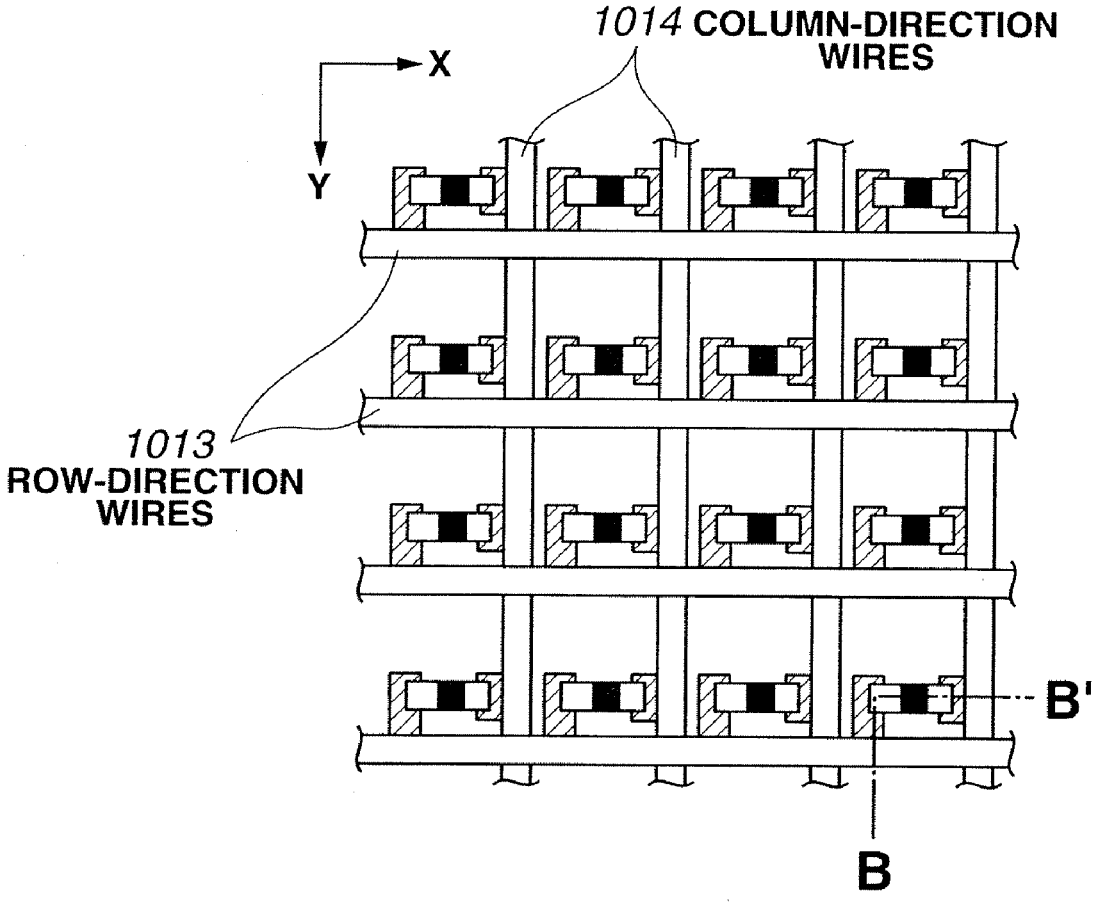
FIG. 13 is a plan view illustrating a substrate of a multi-electron-beam source used in FIG. 1.

FIG. 13 is a plan view illustrating a multi-electron-beam source used in the display panel shown in FIG. 1. On the substrate 1011, surface-conduction-type emission elements are arranged in the shape of simple matrix by the row-direction wires 1013 and the column-direction wires 1014. At a portion where the row-direction wire 1013 and the column-direction wire 1014 cross, an insulating layer (not shown) is formed between electrodes in order to secure electric insulation.

The multi-electron-beam source having the above-described structure is manufactured by forming in advance the row-direction wires 1013, the column-direction wires 1014, inter-electrode insulating layers (not shown), element electrodes of surface-conduction-type emission elements, and a conductive thin film on the substrate, followed by current-passing forming processing (to be described later) and current-passing activation processing (to be described later) by supplying current to the respective elements via the row-direction wires 1013 and the column-direction wires 1014.

In this embodiment, the substrate 1011 for the multi-electron-beam source is fixed to the rear plate 1015 of the airtight container. However, if the substrate 1011 for the multi-electron-beam source has a sufficient strength, the substrate 1011 itself for the multi-electron-beam source may be used as the rear plate of the airtight container.

The fluorescent screen 1018 is formed on the lower surface of the faceplate 1017. Since a color display apparatus is used in this embodiment, phosphors of three primary colors, i.e., read, green and blue, used in the field of CRT are separately coated on the fluorescent screen 1018. Phosphors of respective colors are coated, for example, in the form of a stripe, as shown in FIG. 14A, and a black conductor 1010 is provided between adjacent phosphor stripes. The black conductor 1010 is provided, for example, in order to prevent deviations in displayed colors even if the electron-beam irradiation position more or less deviates, a decrease in the display contrast by preventing reflection of external light, and charging of the fluorescent screen 1018 due to electron beams. Although graphite is used for the black conductor 1010 as a main component, any other appropriate material may also be used provided that the above-described object is achieved.

Figure 14B:
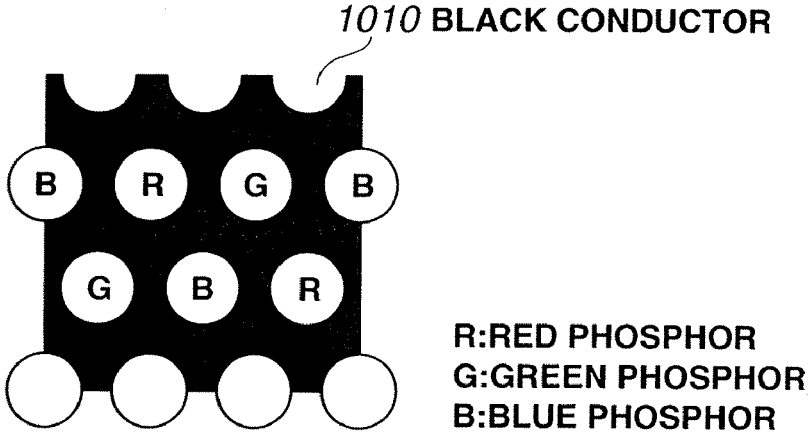
Figure 14C:
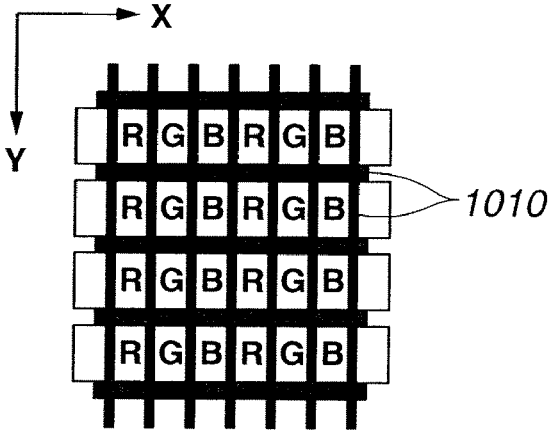

The method of coating the phosphors of three primary colors is not limited to the stripe-shaped arrangement shown in FIG. 14A. For example, a delta-shaped arrangement shown in FIG. 14B, or any other arrangement, such as an arrangement shown in FIG. 14C, may also be adopted.

When forming a monochromatic display panel, a phosphor of a single color may be used for the fluorescent screen 1018, and the black conductor is not necessarily used.

The metal back 1019 that is known in the field of CRT is provided on a surface of the fluorescent screen 1018 facing the rear plate 1015. The metal back 1019 is provided, for example, in order to improve the efficiency of utilization of light by performing mirror reflection of part of light emitted from the fluorescent screen 1018, protect the fluorescent screen 1018 from impingement of negative ions, operate as an electrode for applying an electron-beam acceleration voltage, and cause the fluorescent screen 1018 to operate as a conductive channel for excited electrons. The metal back 1019 is formed by first forming the fluorescent screen 1018 on the faceplate 1017, followed by smoothing processing of the surface of the fluorescent screen 1018, and then depositing Al in a vacuum. When phosphors for a low voltage are used for the fluorescent screen 1018, the metal back 1019 is not used.

Although not used in this embodiment, in order to apply an acceleration voltage or improve conductivity of the fluorescent screen 1018, a transparent electrode, for example, made of ITO (indium tin oxide), may be provided between the faceplate 1017 and the fluorescent screen 1018.

Figure 15:
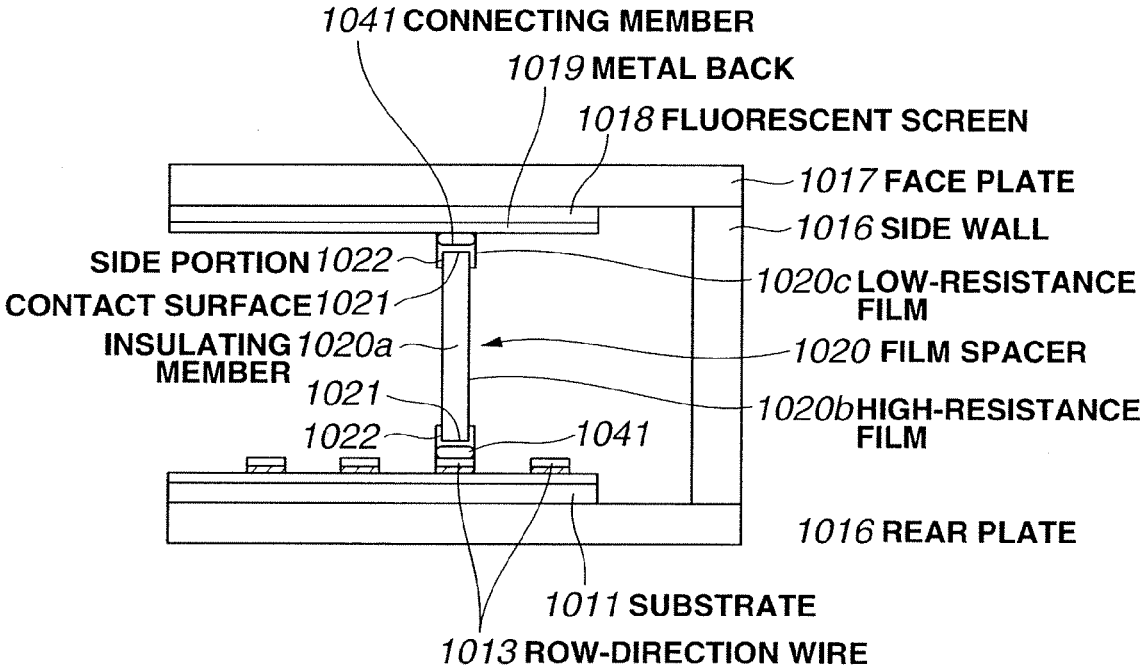
FIG. 15 is a schematic cross-sectional view, taken along line A-A shown in FIG. 1.

FIG. 15 is a schematic cross-sectional view taken along line A-A shown in FIG. 1. In FIG. 15, reference numerals for respective components correspond to those shown in FIG. 1. The spacer 1020 is obtained by forming a high-resistance film 1020*b* for preventing charging on the surface of an insulating member 1020*a*, and forming a low-resistance film 1020*c* on contact surfaces 1021 facing the inside of the faceplate 1017 (the metal back 1019 or the like) and the surface of the substrate 1011 (the row-direction wire 1013 or the column-direction wire 1014), and side portions 1022 connected to the contact surfaces 1021. The spacers 1020 are disposed with a number necessary for achieving the above-described object with a necessary interval, and fixed on the inner side of the faceplate 1017 and the surface of the substrate 1011 by means of connecting members 1041. The high-resistance film 1020*b* is formed on at least a portion exposed to the vacuum within the airtight container of the surface of the insulating member 1020*a*, and is electrically connected to the inside of the faceplate 1017 (the metal back 1019 or the like) and the surface of the substrate 1011 (the row-direction wire 1013 or the column-direction wire 1014) via the low-resistance films 1020*c* and the connecting members 1041 on the spacer 1020. In this embodiment, the spacers have the shape of a thin plate, are disposed parallel to the row-direction wires 1013, and are electrically connected to the row-direction wires 1013.

The spacers 1020 must have an insulating property so as to endure a high voltage applied between the row-direction wires 1013 and the column-direction wires 1014 on the substrate 1011 and the metal back 1019 on the inner surface of the faceplate 1017, and have a conductive property so as to prevent charging on the surfaces of the spacers 1020.

For example, quartz glass, glass in which the contents of impurities, such as Na and the like, are reduced, soda-lime glass, ceramics, such as alumina or the like, may be used for the supporting members 1030 for the spacer 1020. The insulating member 1020*a* preferably has a coefficient of thermal expansion close to those of materials for the airtight container and the substrate 1011.

A current having a value obtained by dividing an acceleration voltage Va applied to the faceplate 1017 (the metal back 1019 or the like) at the high potential side by the resistance value Rs of the high-resistance film 1020*b*, serving as a charging preventing film. The resistance value Rs of the spacer 1020 is set within a desired range in consideration of prevention of charging and power consumption. The surface resistance R/□ is preferably equal to or less than $10^{14}\Omega$, and more preferably, equal to or less than $10^{13}\Omega$ in order to obtain a sufficient charging preventing effect. Although the lower limit of the surface resistance depends on the shape of the spacer 1020 and the voltage applied between the spacers 1020, the surface resistance is preferably at least $10^{7}\Omega$.

The thickness t of the charging preventing film formed on the insulating material is desirably within a range of 10 nm-1 μm.

Although it depends on the surface energy of the material, the adhesive property with the substrate, and the substrate temperature, a thin film having a thickness equal to or less than 10 nm is generally formed in the shape of islands, and has an instable resistance value and poor reproducibility. When the film thickness t exceeds 1 μm, the film stress increases, thereby increasing the possibility of film peeling, and the productivity is low because a long time is required for forming the film. Accordingly, the film thickness is desirably 50-500 nm. The surface resistance R/□ is ρ/t, and the resistivity ρ of the charging preventing film is preferably $10\text{-}10^{10}$ Ωcm from the above-described preferable ranges of R/□ and t. In order to realize the more preferable ranges of the surface resistance and the film thickness, ρ may be $10^{4}\text{-}10^{8}$ Ωcm.

As described above, the temperature of the spacer 1020 raises due to current flow in the charging preventing film formed thereon, or heating of the entire display during an operation. If the temperature coefficient of resistance of the charging preventing film has a large negative value, the resistance value decreases when the temperature raises, thereby increasing the current flowing through the spacer 1020, and a further temperature rise. The current continues to increase until the current value exceeds the limit of the power supply. The condition for generating such current runaway is characterized by the value of the temperature coefficient of resistance TCR expressed by the following general equation (ξ), where ⊿T and ⊿R represent increments of the temperature T and the resistance value R, respectively, of the spacer 1020 in a state of actual driving at the room temperature:

$$TCR = \Delta R / \Delta T / T \times 100 (\%/^\circ C.) \qquad \text{general equation } (\xi).$$

The condition for generating current runaway in terms of TCR is empirically equal to or less than −1 (%/° C.). That is, the temperature coefficient of resistance of the charging preventing film is desirably at least −1 (%/° C.).

For example, a metal oxide may be used as the material for the high-resistance film 1020*b* having a charging preventing property. An oxide of chromium, nickel or copper from among metal oxides is preferable, because these oxides have relatively low secondary-electron emission efficiencies, so that charging hardly occurs even when electrons emitted from the cold-cathode element 1012 impinges upon the spacer 1020. In addition to the above-described metal oxides, carbon is also preferable because it has a small secondary-electron emission efficiency. Particularly, since amorphous carbon has high resistivity, the resistance of the spacer 1020 can be controlled to a desired value.

Nitride of an alloy of germanium and a transition metal, or nitride of an alloy of aluminum and a transition metal is a suitable as another material for the high-resistance film 1020*b* having a charging preventing property, because the resistance value can be controlled within a wide range from a good conductor to an insulator by adjusting the composition of the transition metal.

Furthermore, the above-described materials are stable because the resistance value little changes in a process for manufacturing the display apparatus (to be described later). The above-described materials can be practically used easily because the temperature coefficient of resistance is at least −1(%/° C.). The transition metals include W. Ti, Cr, Ta and the like.

The alloy nitride film is formed on an insulating member according to a thin-film forming method, such as sputtering, reactive sputtering in a nitrogen-gas atmosphere, electron-beam vacuum deposition, ion plating, ion-assisted vacuum deposition or the like. The metal-oxide film may be formed according to a similar thin-film forming method. In this case, oxygen gas is used instead of nitrogen gas. The metal-oxide film may also be formed according to CVD (chemical vapor deposition) or alkoxide coating. The carbon film is formed according to vacuum deposition, sputtering, CVD, or plasma CVD. Particularly, when forming an amorphous-carbon film, hydrogen is contained in an atmosphere during film formation, or hydrocarbon gas is used as the film forming gas.

The low-resistance film 1020*c* constituting the spacer 1020 is provided in order to electrically connect the high-resistance film 1020*b* to the faceplate 1017 (the metal back 1019 or the like) at the high potential side and the substrate 1011 (the wire 1013, 1014 or the like) at the low potential side, and is sometimes hereinafter termed an "intermediate electrode layer (intermediate layer). The intermediate electrode layer (intermediate layer) can have a plurality of functions to be described below.

The high-resistance film 1020*b* is electrically connected to the faceplate 1017 and the substrate 1011. As already described, the high-resistance film 1020*b* is provided in order to prevent charging on the surface of the spacer 1020. When the high-resistance film 1020*b* is connected to the faceplate 1017 (the metal back 1019 or the like) and the substrate 1011 (the wire 1013, 1014 or the like) directly or via the connecting member 1041, there is the possibility that a large contact resistance is produced at the connecting interface, and charges generated on the surface of the spacer 1020 cannot be promptly removed. In order to prevent this possibility, low-resistance intermediate layers are provided on the contact surfaces 1021 of the spacer 1020 contacting the face plate 1017, the substrate 1011 and the connecting members 1041, or the side portions 1022 of the spacer 1020.

The potential distribution on the high-resistance film 1020*b* is made uniform because of the following reason.

Electrons emitted from the cold-cathode element 1012 produce an electron trajectory in accordance with the potential distribution formed between the faceplate 1017 and the substrate 1011. In order to prevent disturbance in the electron trajectory near the spacer 1020, it is necessary to control the potential distribution over the entire region of the high-resistance film 1020*b*. When the high-resistance film 1020*b* is connected to the faceplate 1017 (the metal back 1019 or the like) and the substrate 1011 (the wire 1013, 1014 or the like) directly or via the connecting member 1041, variations in the connection state occur due to the contact resistance at the connecting interface, thereby causing the possibility that the potential distribution on the high-resistance film 1020*b* shifts from a desired value. In order to avoid this possibility, a low-resistance intermediate layer is provided over the entire region of spacer end portions (the contact surfaces 1021 and the side portions 1022) where the spacer 1020 contacts the faceplate 1017 and the substrate 1011. By applying a desired voltage to the intermediate layer, the potential of the entire high-resistance film 1020*b* can be controlled.

The trajectory of emitted electrons is also controlled because of the following reason.

Electrons emitted from the cold-cathode element 1012 produce an electron trajectory in accordance with the potential distribution formed between the faceplate 1017 and the substrate 1011. As for electrons emitted from a cold-cathode element near the spacer 1020, limitations (for example, changes in the positions of the wire and the element) are sometimes provided due to disposition of the spacer 1020. In such a case, in order to form an image that does not have distortion and unevenness, electrons must be projected onto a desired position on the faceplate 1017 by controlling the trajectory of emitted electrons. By providing low-resistance intermediate layers on the side portions 1022 of the surfaces contacting the faceplate 1017 and the substrate 1011, it is possible to provide the potential distribution near the spacer 1020 with desired characteristics, and control the trajectory of emitted electrons.

A material having a resistance value sufficiently lower than that of the high-resistance film 1020*b* may be selected for the low-resistance film 1020*c*. For example, a metal, such as Ni, Cr, Au, Mo, W, Pt, Ti, Al, Cu, Pd or the like, an alloy of some of these elements, a printing conductor including a metal or a metal oxide, such as Pd, Ag, Au, $RuO_2$, Pd—Ag or the like, glass and the like, a transparent conductor, such as $In_2O_3$—$SnO_2$ or the like, a semiconductor, such as polysilicon or the like, may be appropriately selected.

For example, an inorganic adhesive including frit glass or a ceramic material, such as alumina or the like, as a base material, or a low-melting-point metal, such as solder, indium or the like, may be used as the material for the first and second connecting members 1052 and 1053. Properties required for the first and second connecting members 1052 and 1053 include, for example, a coefficient of thermal expansion close to those of the spacer 1020, the supporting member 1030, the faceplate 1017 and the rear plate 1015, and least generation of unnecessary gases in a vacuum.

There are also provided the airtight terminals for electric connection Dx1-Dxm, Dy1-Dyn and Hv for electrically connecting the display panel to an electric circuit (not shown). The terminals Dx1-Dxm, Dy1-Dyn and Hv are electrically connected to the row-direction wires 1013 and the column-direction wires 1014 of the multi-electron beam source, and the metal back 1019 of the faceplate 1017, respectively.

In order to evacuate the inside of the airtight container to a vacuum, after assembling the airtight container, an exhaust tube (not shown) is connected to a vacuum pump, the inside of the airtight container is evacuated to a degree of vacuum of about $10^{-7}$ Torr. Then, the exhaust tube is sealed. In order to maintain the degree of vacuum within the airtight container, a getter film (not shown) is formed at a predetermined position within the airtight container immediately before sealing, or after sealing. The getter film is formed by heating and evaporating a getter material having, for example, Ba as a main component according to high-frequency heating. According to the adsorption function of the getter film, the inside of the airtight container is maintained to a degree of vacuum of $1\times10^{-5}$-$1\times10^{-7}$ Torr.

In the image display apparatus using the above-described display panel, when a voltage is applied to each of the cold-cathode elements 1012 via corresponding ones of the outside-container terminals Dx1-Dxm and Dy1-Dyn, electrons are emitted from the corresponding one of the cold-cathode elements 1012. At the same time, by applying a high voltage of several hundred to several thousand volts to the metal back 1019 via the outside-container terminal Hv, the emitted electrons are accelerated to impinge upon the inner surface of the faceplate 1017. A corresponding one of the phosphors of respective colors constituting the fluorescent screen 1018 is thereby excited to emit light, whereby an image is displayed.

Usually, the voltage applied to the surface-conduction-type emission elements of the invention, i.e., the cold-cathode elements 1012, is about 12-16 V, the distance d between the metal back 1019 and the cold-cathode elements 1012 is about 0.1-8 mm, and the voltage between the metal back 1019 and the cold-cathode elements 1012 is about 0.1-10 kV.

An outline of the basic configuration and the manufacturing method of the display panel according to the embodiment of the present invention, and the image display apparatus has been described.

EXAMPLES

Next, the supporting members for the spacer, the rear plate that have been described in the foregoing embodiment, and a method for connecting these components will be described in detail illustrating specific materials and numerical values. However, the present invention is not limited to these examples.

Example 1

In Example 1 of the invention, a case of manufacturing the display panel shown in FIGS. 1-6 will be described.

Manufacture of the Electron Source

First, as shown in FIG. 1, the row-direction wires 1013, the column-direction wires 1014, the inter-electrode insulating layers (not shown), element electrodes of the cold-cathode elements 1012, serving as surface-conduction-type electron emission elements, and a conductive thin film were formed in advance on the substrate 1101.

Manufacture of the Spacer Substrate

Then, the spacers 1020 (see FIG. 1), serving as the atmospheric-pressure-resistant structure of the display panel, were manufactured using insulating members (300 mm×2 mm×0.2 mm) made of soda-lime glass. The spacers 1020 were manufactured by first forming a long substance having a cross section of 2 mm×0.2 mm according to heat drawing, and then cutting the substance to a required length.

High-Resistance Film of the Spacer and Electrode-Film Forming

A high-resistance film (to be described later) was formed on four surfaces (surface and back rectangular sides having sizes of 300 mm×2 mm and a size of 300 mm×0.2 mm) of the spacer 1020 within the image display region of the airtight container, and a conductive film was formed on two surfaces (having a size of 300 mm×0.2 mm) of the spacer 1020 contacting the rear plate 1015 and on regions (300 mm×0.2 mm) from the sides contacting the faceplate 1017 and the rear plate 1015 to the height of 0.1 mm of the surface of 300 mm×2 mm. A Cr—Al alloy nitride film (200 nm thick with a surface resistance of about $10^9\Omega/\square$) formed by performing simultaneous sputtering of Cr and Al targets using a high-frequency power supply was used as the high-resistance film. The conductive film is provided in order to secure electric connection between the high-resistance film formed on the spacer 1020 and the face plate 1017, and between the high-resistance film and the rear plate 1015, and in order to control the trajectory of electrons emitted from the electron emission element by suppressing the electric field near the spacer 1020.

Supporting Member

For example, quartz glass, glass in which the contents of impurities, such as Na and the like, are reduced, soda-lime glass, ceramics, such as alumina or the like, may be used for the supporting members 1030 for the spacers 1020. The supporting member 1030 preferably has a coefficient of thermal expansion close to those of materials for the airtight container and the substrate 1011.

Figure 16:
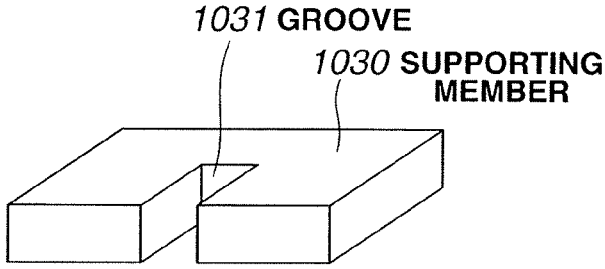
FIG. 16 is a perspective view illustrating the supporting member for supporting the spacer within the display panel.
Figure 17:
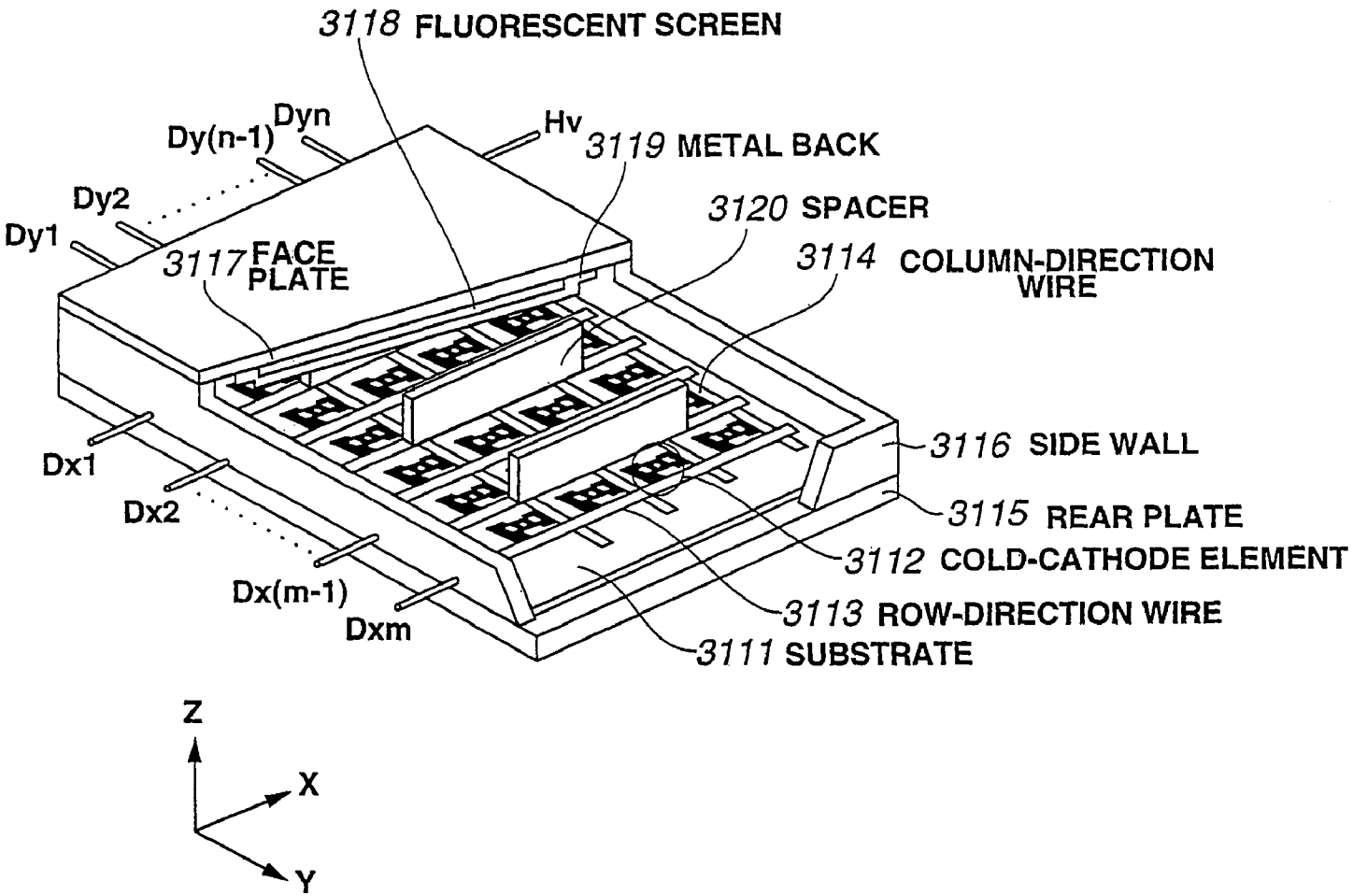
FIG.17 (PRIOR ART)
FIG. 17 is a perspective view illustrating a display panel constituting a conventional flat image display apparatus, in which a portion of the display panel is cut in order to show the internal structure.

As shown in FIG. 16, the supporting member 1030 fixed to the spacer 1020 is formed with a length and width of 5 mm, and a height of 0.5 mm, and has a groove 1031 (0.25 mm wide) 2 mm long for receiving the spacer 1020 at a central portion.

Rear Plate

As shown in FIG. 2, the upper surface 1013*a* of the row-direction wire 1013 contacted by the spacer 1020 within the electron emission region of the rear plate 1015 and a portion outside of the electron emission region of the rear plate 1015 where the supporting member 1030 is fixed have substantially the same thickness in the direction of the thickness of the substrate.

First and Second Connecting Members

An inorganic adhesive including alumina as a basic material was used for both of the first and second connecting members 1052 and 1053. The first and second connecting members 1052 and 1053 differ in the particle diameter of alumina, serving as the basic material. Since the adhesion area allowed for fixing of the spacer 1020 and the supporting member 1030 is relatively small, alumina particles having a particle diameter of about 50 μm were used for the second connecting member 1052. On the other hand, since the adhesion area between the supporting member 1030 and the rear plate 1015 is large, alumina particles having a particle diameter of about 100 μm were used for the first connecting member 1053.

Assembly of the Spacer and the Supporting Member

By inserting the groove (0.25 mm wide and 2 mm long) 1031 provided at the central portion of the supporting member 1030 at each of both end portions of the spacer 1020, the spacer 1020 is fixed by the second connecting members 1052. At that time, a space is provided between the plane 1020*d* including a face of the spacer 1020 facing the spacer disposing surface of the rear plate 1015 and the surface 1030*a* of the supporting member 1030 facing the spacer disposing surface of the rear plate 1015, and the supporting members 1030 are provided in a space between the plane 1020*d* of the spacer 1020 including a surface facing the spacer disposing surface of the rear plate 1015 and a plane 1020*e* of the spacer 1020 including a surface opposite to a surface facing the rear plate 1015.

Assembly of the Spacer and the Rear Plate

The spacer 1020 is positioned by the spacer assembling apparatus so as to be substantially vertical on the center of the row-direction wire 1013 within the electron emission region of the rear plate 1015, and the supporting members 1030 are fixed on the rear plate 1015 by first connecting members 1053. At that time, a space is provided between a plane including a surface of the spacer 1020 facing the spacer disposing surface of the rear plate 1015 and surfaces of the supporting members 1030 facing the rear plate 1015, and the supporting members 1030 are provided within a space provided between a plane including the surface of the spacer 1020 facing the spacer disposing surface of the rear plate 1015 and a plane including the opposite surface of the spacer 1020 (see FIGS. 3-5), the supporting members 1030 do not contact the rear plate 1015 (see FIG. 6). Accordingly, the first connecting members 1053 are fixed by contacting the rear plate 1015 so as to be along the outer circumference of the supporting members 1030 and the surface of the rear plate 1015.

Sealing of the Rear Plate and the Faceplate

Then, as shown in FIG. 1, the side wall 1016 was disposed on the rear plate 1015 via frit glass, and the frit glass was also coated at a portion of the side wall 1016 that is to contact the faceplate 1017. The fluorescent screen 1018 of respective colors in the form of stripes extending along the row-direction wire (y direction) and the metal back 1019 are provided on the inner surface of the faceplate 1017.

The plane of the faceplate 1017 and the plane of the rear plate 1015 were made parallel and caused to approach, and the side wall 1016, the faceplate 1017 and the rear plate 1015 were connected and sealed by performing firing at 400-500° C. for at least 10 minutes.

Electron-Source Manufacturing Process and Sealing

The inside of the airtight container completed in the above-described manner was evacuated by a vacuum pump via an exhaust pipe (not shown). After a sufficient vacuum was obtained, a multi-electron-beam source was manufactured by performing the current-passing forming processing and the current-passing activation processing that has been described in the foregoing embodiment, by supplying respective elements with current via the row-direction wires 1013 and the column-direction wires 1014 from the outside-container terminals Dx1-Dxm, and Dy1-Dyn.

Then, the envelope (airtight container) was sealed by fusing the exhaust pipe by being heated by a gas burner in a degree of vacuum of about $1\times10^{-6}$ Torr.

Finally, in order to maintain the degree of vacuum after sealing, gettering processing was performed.

Image Display

In the image display apparatus having the display panel shown in FIG. 1 completed in the above-described manner, an image was displayed by emitting electrons by applying a scanning signal and a modulation signal to the cold-cathode elements (surface-conduction-type electron emission elements) 1012 by signal generation means (not shown) via the outside-container terminals Dx1-Dxm and Dy1-Dyn, accelerating the emitted electron beam by applying a high voltage to the metal back 1019 via the high-voltage terminal Hv to cause electrons to impinge upon the fluorescent screen 1018 to excite phosphors of respective colors to emit light. The application voltage Va to the high-voltage terminal Hv was 3-10 kV, and the application voltage Vf to the respective wires 1013 and 1014 was 14 V.

At that time, a string of emitted light spots with an equal interval was formed two-dimensionally including an emitted light spot by emitted electrons from the cold-cathode element 1012 near the spacer 1020, and clear color image display having excellent color reproducibility could be performed.

Example 2

Example 2 of assembling will now be described with reference to FIGS. 7-10.

Rear Plate

In Example 2, while the row-direction wires 1013 and the column-direction wires 1014 for driving electron sources for emitting electrons, and the insulating layers 1050 for electrically insulating the row-direction wires 1013 from the column-direction wires 1014 are formed within the electron-emission region of the rear plate 1015, only the row-direction wires 1013 are formed at extended portions of the row-direction wires 1013 outside of the electron emission region of the rear plate 1015. Accordingly, a portion of the row-direction wire 1013 facing the supporting member 1030 outside of the electron emission region of the rear plate 1015 is thinner in the direction of the thickness than the upper surface 1013*a* of the row-direction wire 1013 contacted by the spacer 1020 within the electron emission region of the rear plate 1015.

Assembly of the Spacer and the Supporting Members

By inserting the groove (0.25 mm wide and 2 mm long) 1031 provided at the central portion of the supporting member 1030 at each of both end portions of the spacer 1020, the spacer 1020 is fixed by the second connecting members 1052. As for the fixed position of the spacer 1020 and supporting members 1030, it is not particularly necessary to provide a space between the plane including the surface of the spacer 1020 facing the spacer disposing surface of the rear plate 1015 and the surface of the supporting member 1030 facing the spacer disposing surface of the rear plate 1015. No problem arises even if the surface of the supporting member 1030 facing the spacer disposing surface of the rear plate 1015 is closer to the rear plate 1015 than the surface of the spacer 1020 facing the spacer disposing surface of the rear plate 1015. However, the value of the dimension for allowing the surface of the supporting member 1030 facing the spacer disposing surface of the rear plate 1015 to be closer to the rear plate 1015 than the plane of the spacer 1020 including the surface facing the spacer disposing surface of the substrate where the spacer 1020 is disposed must be smaller than the difference between the dimensions in the direction of thickness between the upper surface 1013*a* of the row-direction wire 1013 contacted by the spacer 1020 within the electron emission region of the rear plate 1015 and the portion 1013*b* of the row-direction wire 1013 where the supporting member 1030 outside of the electron emission region of the rear plate 1015 is fixed.

Assembly of the Spacer and the Rear Plate

The spacer 1020 is positioned by the spacer assembling apparatus so as to be substantially vertical on the center of the row-direction wire 1013 within the electron emission region of the rear plate 1015, and the supporting members 1030 are bonded and fixed on the rear plate 1015 by means of the first connecting members 1053. At that time, since the portion 1013*b* of the row-direction wire 1013 facing the supporting member 1030 outside of the electron emission region of the rear plate 1015 is thinner in the direction of the thickness than the upper surface 1013*a* of the row-direction wire 1013 contacted by the spacer 1020 within the electron emission region of the rear plate 1015, the supporting members 1030 do not contact the rear plate 1015. Accordingly, as in Example 1, by providing the first connecting members 1053 so as to be along the outer circumference of the supporting members 1030 and the surface of the rear plate 1015, the supporting members 1030 are fixed on the rear plate 1015.

"Sealing of the rear plate and the faceplate" and the "electron-source manufacturing process and sealing" are the same as in Example 1.

According to the present invention, the supporting members fixed to the spacers do not directly contact the substrate. Accordingly, verticality of the spacers with respect to the substrate, and the height of disposition when the spacers are fixed on the substrate do not vary by being influenced by accuracy in assembly of the spacer and the supporting members. It is thereby possible to realize very high accuracy in the verticality of the spacers with respect to the substrate, and prevent variations in the height of disposition when the spacers are fixed on the substrate.

As a result, the spacers after assembly contact the first substrate and the second substrate as designed, and a vacuum within the envelope can be maintained with high reliability.

Since the positions of the spacers do not deviate, the trajectory of electrons emitted from the first substrate side is not influenced.

Since accuracy in assembly of the spacer and the supporting members can be loosely set, it is possible to fix the spacer and the supporting members with an easy method, and loosen accuracy of each supporting member. It is thereby possible to increase the throughput of assembly of the spacer and the supporting members, and suppress the cost of each supporting member to a low value.

The individual components shown in outline in the drawings are all well known in the low-pressure container and image forming apparatus arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A vacuum container frame comprising:

a first substrate having a planar surface;

a second substrate having a planar surface arranged to face the planar surface of said first substrate;

a plate-like spacer disposed between said first substrate and said second substrate, with said spacer extending in a longitudinal direction substantially parallel with the planar surfaces;

supporting members fixed to both ends of said plate-like spacer in the longitudinal direction such that a gap is provided between said supporting members and the planar surface of said first substrate or a member disposed on the planar surface of said first substrate and such that surfaces of said supporting members which face the planar surface of said first substrate or the member disposed on the planar surface of said first substrate are positioned further away from the planar surface of said first substrate or the member disposed on the planar surface of said first substrate than a surface of said plate-like spacer which faces the planar surface of said first substrate or the member disposed on the planar surface of said first substrate;

connecting members for connecting each of said supporting members to the surface of said first substrate or to the member disposed on the surface of said first substrate; and peripheral side walls disposed between said first and second substrates.

2. An image display apparatus comprising:

a first substrate having a planar surface;

a second substrate having a planar surface arranged to face the planar surface said first substrate;

a plate-like spacer disposed between said first substrate and said second substrate, with said spacer extending in a longitudinal direction substantially parallel with the planar surfaces;

supporting members fixed to both ends of said plate-like spacer in the longitudinal direction such that a gap is provided between said supporting members and the planar surface of said first substrate or a member disposed on the planar surface of said first substrate and such that surfaces of the supporting members which face the planar surface of said first substrate or the member disposed on the planar surface of said first substrate are positioned further away from the planar surface of said first substrate or the member disposed on the planar surface of said first substrate than a surface of said plate-like spacer which faces the planar surface of said first substrate or the member disposed on the planar surface of said first substrate;

connecting members for connecting each of said supporting members to the surface of said first substrate or to said member disposed on the surface of said first substrate;

peripheral side walls disposed between the first and second substrates; and an image display member.

3. An image display apparatus according to claim 2, wherein said first substrate has a plurality of electron emission elements and a plurality of wires for driving said plurality of electron emission elements.

4. An image display apparatus according to claim 3, wherein said spacer contacts said wires.

5. An image display apparatus according to claim 3, wherein said supporting members and the surface of said first substrate or said member disposed on the surface of said first substrate are connected by said connecting members outside of a region in which said plurality of electron emission elements are disposed on said first substrate.

6. An image display apparatus according to claim 5, wherein said spacer contacts said wires.

7. A vacuum container comprising:

a first substrate having a planar surface;

a second substrate arranged to face the planar surface of said first substrate;

a plate-like spacer disposed between said first substrate and said second substrate, with said spacer extending in a longitudinal direction substantially parallel with the planar surface of said first substrate;

supporting members fixed to both ends of said plate-like spacer in the longitudinal direction such that a gap is provided between said supporting members and the planar surface of said first substrate and such that said supporting members are positioned further away from the planar surface of said first substrate than said plate-like spacer, connecting members for connecting each of said supporting members to the surface of said first substrate, and peripheral side walls disposed between said first and second substrates.

* * * * *